US005852986A

United States Patent [19]

Mackal

[11] Patent Number: 5,852,986

[45] Date of Patent: Dec. 29, 1998

[54] AUTOMATIC INFLATOR WITH STATUS INDICATORS

[76] Inventor: Glenn H. Mackal, 2586 25th Ave. North, St. Petersburg, Fla. 33713

[21] Appl. No.: 596,979

[22] Filed: Feb. 5, 1996

[51] Int. Cl.[6] ..... G01L 19/12

[52] U.S. Cl. ..... 116/266; 116/272; 116/281; 222/23

[58] Field of Search ..... 116/266, 277, 116/281, 283, 285, 272, 273, 264, 210, DIG. 8, DIG. 9; 222/5, 23; 441/92–95

[56] References Cited

U.S. PATENT DOCUMENTS

| | | | |
|---|---|---|---|
| 2,662,502 | 12/1953 | Turner | 116/273 |
| 3,182,630 | 5/1965 | Claeys | 116/272 |
| 3,221,932 | 12/1965 | Anderson | 116/210 |
| 3,610,470 | 10/1971 | Waters . | |
| 3,975,785 | 8/1976 | Stadeker | 441/93 |
| 4,223,805 | 9/1980 | Mackal . | |
| 4,267,944 | 5/1981 | Mackal . | |
| 4,946,067 | 8/1990 | Kelsall . | |
| 5,095,845 | 3/1992 | Murphy | 116/210 |
| 5,333,656 | 8/1994 | Mackal | 222/5 |
| 5,413,247 | 5/1995 | Glasa | 222/23 |
| 5,562,233 | 10/1996 | Glasa | 222/23 |
| 5,597,091 | 1/1997 | Mah et al. | 116/272 |
| 5,643,030 | 7/1997 | Brown | 116/277 |

FOREIGN PATENT DOCUMENTS

| | | |
|---|---|---|
| 1559367 | 6/1952 | United Kingdom . |
| 743358 | 6/1952 | United Kingdom . |
| 2194758 | 3/1988 | United Kingdom . |

*Primary Examiner*—Diego F. F. Gutierrez
*Assistant Examiner*—Andrew Hirshfeld
*Attorney, Agent, or Firm*—Ronald E. Smith

[57] ABSTRACT

A $CO_2$ cartridge is permanently attached to a cartridge status indicator so that a user need not perform a detailed inspection to determine if the cartridge has been used or not. If the cartridge has been used, the status indicator will so indicate upon casual visual inspection, and if the cartridge has not been used, the causal inspection will also reveal that fact. The gas is released by two different methods. The first requires only that the user pull a cord. Pulling the cord shifts a support member laterally within the inflator, and previously misaligned legs and bores enter into alignment with one another. When aligned, the legs enter into the bores under the influence of a spring positioned in the inflator and the support member is driven into puncturing relation to a membrane. If moisture is encountered, the cord need not be pulled because the moisture collapses a dissolvable element, and the pierce pin is driven into puncturing relation with the membrane under the force of the spring.

11 Claims, 6 Drawing Sheets

AUTOMATIC INFLATOR WITH STATUS INDICATORS

BACKGROUND OF THE INVENTION

1. Field of the Invention

This invention relates, generally, to devices that indicate whether or not a $CO_2$ cartridge has been used. More particularly, it relates to a status indicating device that is permanently attached to a $CO_2$ cartridge.

2. Description of the Prior Art $CO_2$ cartridges that are used to rapidly inflate life vests and other inflatable articles in emergency situations can be used only once. A careful visual inspection of the cartridge will reveal whether or not it has been used, but only if the cartridge is first removed from the inflator to which it is attached. Thus, where there are many lifejackets with attached inflators, it is not practical to remove, inspect, and re-attach the cartridges to determine which ones have been used and which ones have not.

There is a need, then, for a means that indicates the status of a cartridge even when the cartridge is connected to an inflator. An ideal status indicator would remain attached to the cartridge at all times so that there would be no cartridges lacking a status indicator; unsafe-to-rely-upon cartridges would then not be found lying around awaiting use.

There are numerous other limitations with the inflators in use today. Most of the additional limitations have to do with the serviceability of the devices, i.e., they require careful servicing or care and they will fail when needed if proper care and servicing have not been carried out with diligence. Clearly, there is a need for an inflator that requires no more servicing than the replacement of spent cartridges.

Conventional inflators typically require a cocking operation after a cartridge has been installed; if the cocking operation is forgotten, the cartridge will not be ready when needed. Conventional inflators also often require pill or "bobbin" installations, in addition to the cartridge installation. Some further require installation of a safety clip. There are no known inflators that require no service other than simple installation of the cartridge itself. Clearly, if an inflator could be provided having no care or service requirements other than cartridge installation, the chances for inflator failure due to improper care and preparation would be significantly reduced.

Inflator failure can also occur due to inflator-cartridge mismatching; for example, the attachment of a small cartridge to an inflator built for large cartridges, and so on. A need thus exists for an inflator having means that defeats attempted attachments thereto of improperly sized cartridges.

Manufacturers of $CO_2$ cartridges have long complained to inflator manufacturers that the cartridges are mounted upside-down when used, i.e., the liquified carbon dioxide rests against the membrane that is punctured when inflation of an article is required, and a gaseous compound pocket or space is formed at the opposite, closed end of the cartridge. Thus, when an inflator is activated, the liquified $CO_2$ flows downwardly through the neck of the cartridge and into the article to be inflated. This can cause icing of the cartridge and restricted flow therefrom, especially in cold weather. If the cartridge were mounted in an upright configuration, the gaseous pocket would be at the top of the cartridge; thus, puncturing the membrane would allow the liquified gas to evaporate through the puncture, instead of flowing therethrough while still in a liquified state. If the cartridge could be used in such upright position, the occurrences of the icing phenomenon would be reduced and perhaps even eliminated. However, it is the conventional wisdom in the inflator industry that the cartridges must be mounted in inverted disposition due to the restrictions of inflator design.

Clearly, a new inflator design that enables upright mounting of carbon dioxide cartridges is highly desirable.

Additional desirable features in an improved inflator design would include reduced cost and enhanced resistance to humidity and water splashes.

In view of the prior art at the time the present invention was made, it was not obvious to those of ordinary skill in the art how all of the limitations recited above could be overcome. The conventional wisdom is that if such limitations could be overcome, the resulting inflator would be prohibitively expensive.

SUMMARY OF THE INVENTION

The present invention includes a cartridge status indicator that is attached to a carbon dioxide cartridge at all times so that the cartridge need never be removed from an inflator or otherwise manipulated prior to inspection. The cartridge status indicator is in a first position relative to the cartridge when the cartridge is unused and in a second position relative to the cartridge when the cartridge is spent. There are a pair of supplemental status indicators, each of which provides a color-coded, highly visible indicator that informs an inspector of the status of a cartridge at a glance, but the primary cartridge status indicator is the position of the cartridge status indicator relative to the cartridge.

Moreover, the novel inflator disclosed herein has no service requirements other than installation of an unused cylinder. It requires no separate cocking, no pill or "bobbin" installation, no safety clip, or the like. Additionally, its mechanical construction rejects the attachment of any mismatched cartridge. It has enhanced resistance to humidity, exhibits superior splash/spray characteristics, and has an aesthetically pleasing, compact design for use in "horseshoe" vest designs.

The novel inflator also provides the world's first mounting that enables top-venting of the $CO_2$ cartridge mounted thereto. This is accomplished by a unique inflator design that accepts a bottom-mounted cartridge, i.e., a cartridge in upstanding configuration with the membrane thereof at the top so that liquid gas is not supported thereby as in the earlier, inverted designs.

More specifically, the improvement in $CO_2$ inflators includes a cartridge status indicator that is nonremovably mounted to a $CO_2$ cartridge. The indicator has a first position with respect to the cartridge that indicates nonuse of said cartridge and a second position with respect to the cartridge that indicates use of the cartridge. The cartridge status indicator and the cartridge are in axial alignment with one another when the cartridge status indicator is in said first and second positions.

The cartridge status indicator includes a window means formed therein. A mounting plate is disposed within the cartridge status indicator, and a first and a second indicia are mounted on said mounting plate in axially spaced relation to one another so that the first indicia means is visible through the window when the cartridge status indicator is in said first position, and so that the second indicia means is visible through the window when the cartridge status indicator is in said second position.

The cartridge status indicator is releasably attachable to the inflator means, but said indicator is permanently attached to a cartridge. This ensures that every cartridge has a status indicator attached to it so that there can be no substantial doubt as to whether or not a cartridge has been used.

The novel assembly further includes a bias means mounted within the inflator means, a pierce pin assembly positioned within the inflator means and disposed in abutting relation to a leading end of the bias means. The pierce pin assembly is slideably mounted so that unloading of the bias means drives the pierce pin through a cartridge membrane. Suitable means hold the pierce pin in retracted relation relative to the membrane when the inflator means is in its unactivated configuration.

The pierce pin assembly further includes a base disposed at a leading end of the bias means, a plurality of peripheral legs having a common length formed integral with the base, a central leg having a length greater than said common length, said peripheral legs and said central leg projecting in a first direction relative to said base in parallelism with one another and in parallel relation to a longitudinal axis of said inflator means.

A pierce pin has a base engaged by the central leg and a pointed free end for piercing a cartridge membrane.

The pierce pin assembly further includes a central sleeve that projects in a second direction relative to the pierce pin assembly base, said second direction being opposite to said first direction, and a spider assembly disposed in abutting relation to a trailing end of said bias means. The spider assembly includes a central post that is slideably received within the pierce pin assembly central sleeve so that the bias means urges the pierce pin assembly and hence the pierce pin in said first direction.

A guide plate member, integral with the cartridge status indicator, is disposed in abutting relation to a leading end of the inflator means. A plurality of upstanding guide legs are formed in the guide plate member, and a corresponding plurality of blind bores are formed in the body of the inflator means. Each guide leg of said plurality of guide legs is slideably received within an associated blind bore when the cartridge status indicator is in said first position relative to said inflator means and when in said second position relative to said indicator so that the cartridge status indicator does not separate from the inflator means when the membrane is pierced.

The peripheral legs abut the trailing side of the guide plate member and a support member is disposed in the cartridge status indicator in abutting relation to the leading side of the guide plate member. A support plate is disposed within the cartridge status indicator in abutting relation to the leading side of the support member and a plurality of upstanding support plate legs are formed in the support plate, said plurality of upstanding support plate legs abutting said support member.

A plurality of blind bores are formed in the support member, said plurality of blind bores being misaligned with said plurality of upstanding legs when said support member is in a position of repose. The guide plate maintains said peripheral legs in their retracted position and thus maintains said pierce pin in spaced relation to the membrane when the support member is in said position of repose. The upstanding support plate legs enter into said plurality of support member blind bores when the support member is laterally displaced from its position of repose, said bias means driving said peripheral legs and hence said guide plate means, support member, and pierce pin toward said membrane so that said membrane is punctured by said pierce pin.

A beveled surface is formed in a peripheral edge of the support member. A handle member is slideably mounted on the body of the inflator means, and a handle member beveled surface is integrally formed with said handle member. The handle member beveled surface is adapted to slidingly engage and laterally displace the support member beveled surface when the handle member is displaced from a first position to a second position relative to said body of said inflator means; the lateral displacement brings into alignment the upstanding support plate legs and the support member blind bores.

A dissolvable element is disposed in the cartridge status indicator in abutting relation to the leading end of the support plate, and a torturous passageway means is formed in the body of the inflator means; the passageway means is in fluid communication with the dissolvable element. The dissolvable element has a predetermined thickness substantially equal to a predetermined depth of said support member blind bores so that dissolution of said dissolvable element has substantially the same effect on said bias means as alignment of said upstanding support plate legs and said support plate blind bores, said same effect being said unloading of said bias means and said driving of said pierce pin into said membrane.

All of these features are provided in a highly novel, pioneering invention that is manufactured at low cost.

An important object of the invention is to provide a novel carbon dioxide cartridge having a status indicator permanently mounted thereto.

Another important object is to provide an inflator having a membrane-puncturing pin that is activated by the pull of a cord or by the exposure of a dissolvable element to moisture.

Other important objects include the provision of a device that achieves the foregoing objects in an economical structure that requires no pre-use cocking, which defeats mismatching of cartridge to inflator, and which has no maintenance requirements other than replacing spent cartridges.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
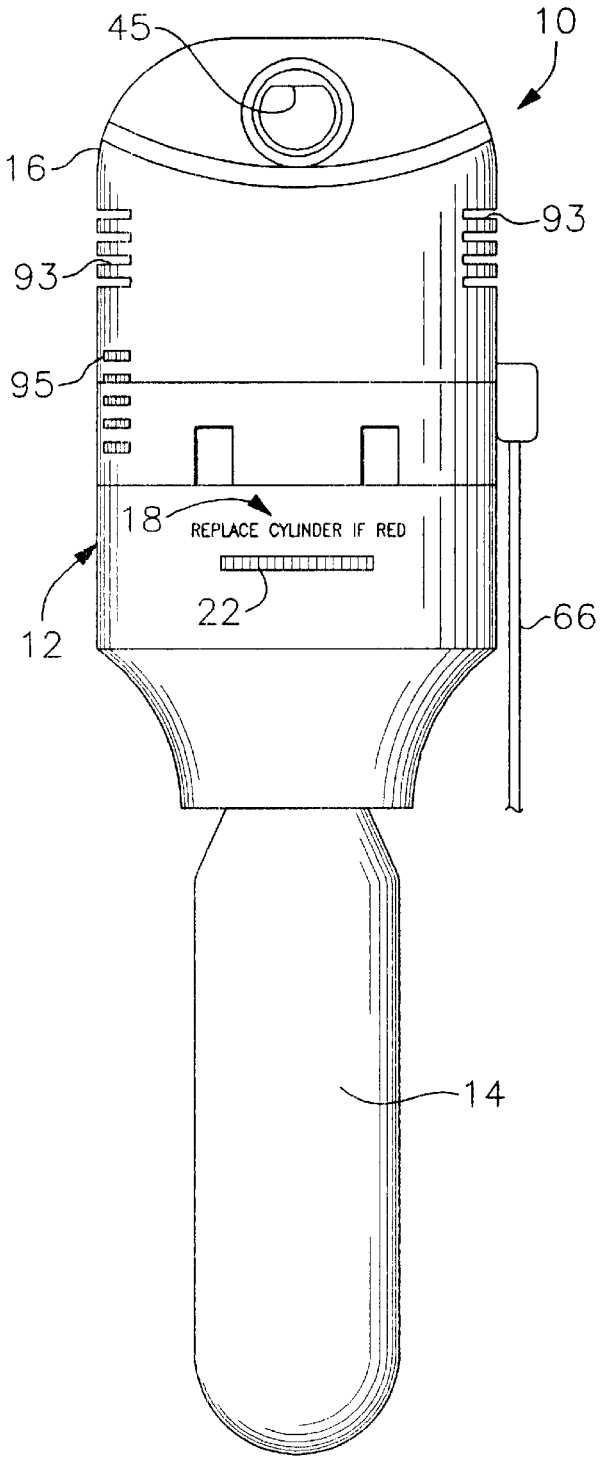
FIG. 1 is a front elevational view of the novel inflator, cartridge status indicator, and cartridge when in their assembled configuration.

Referring now to FIG. 1, it will there be seen that an exemplary embodiment of the invention is denoted as a whole by the reference numeral 10.

Figure 8:
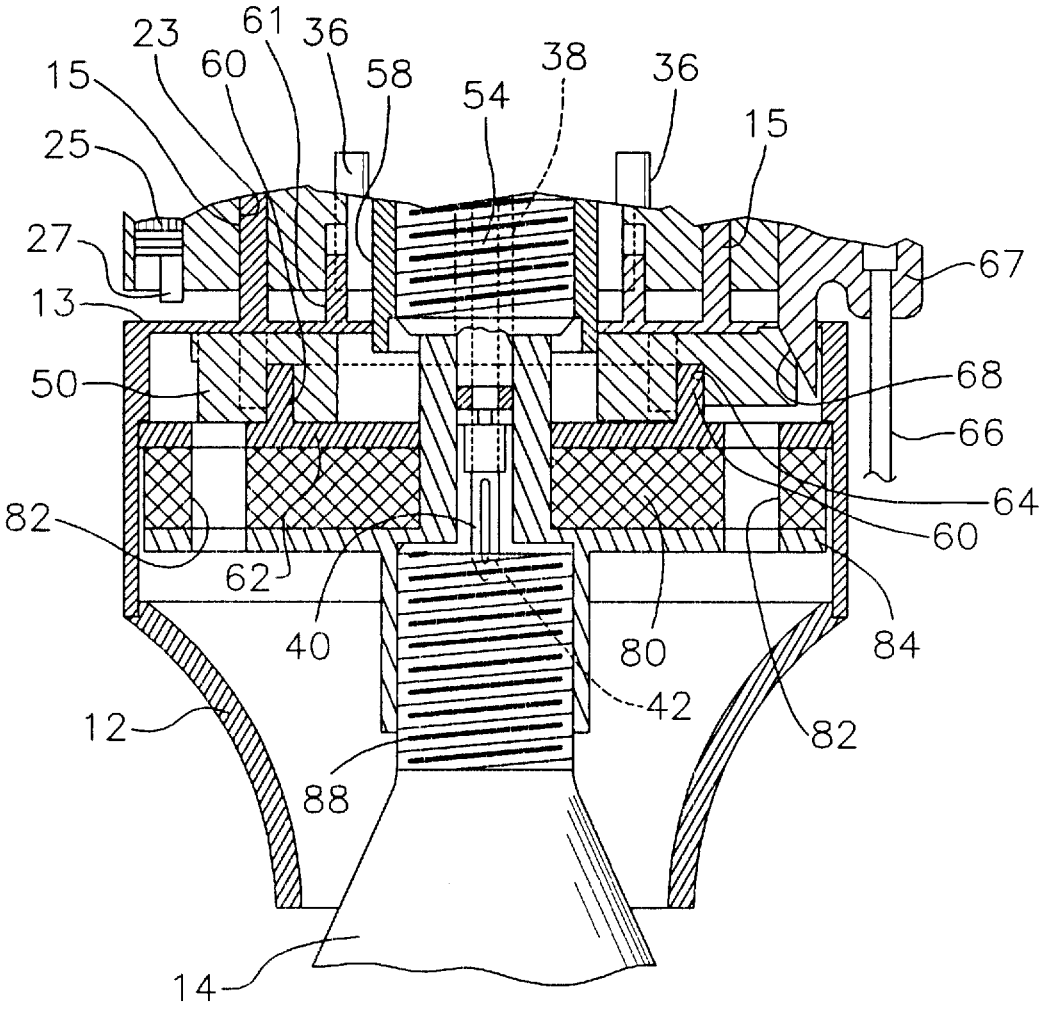
FIG. 8 is a sectional view taken along line 8—8 in FIG. 6.
Figure 9:
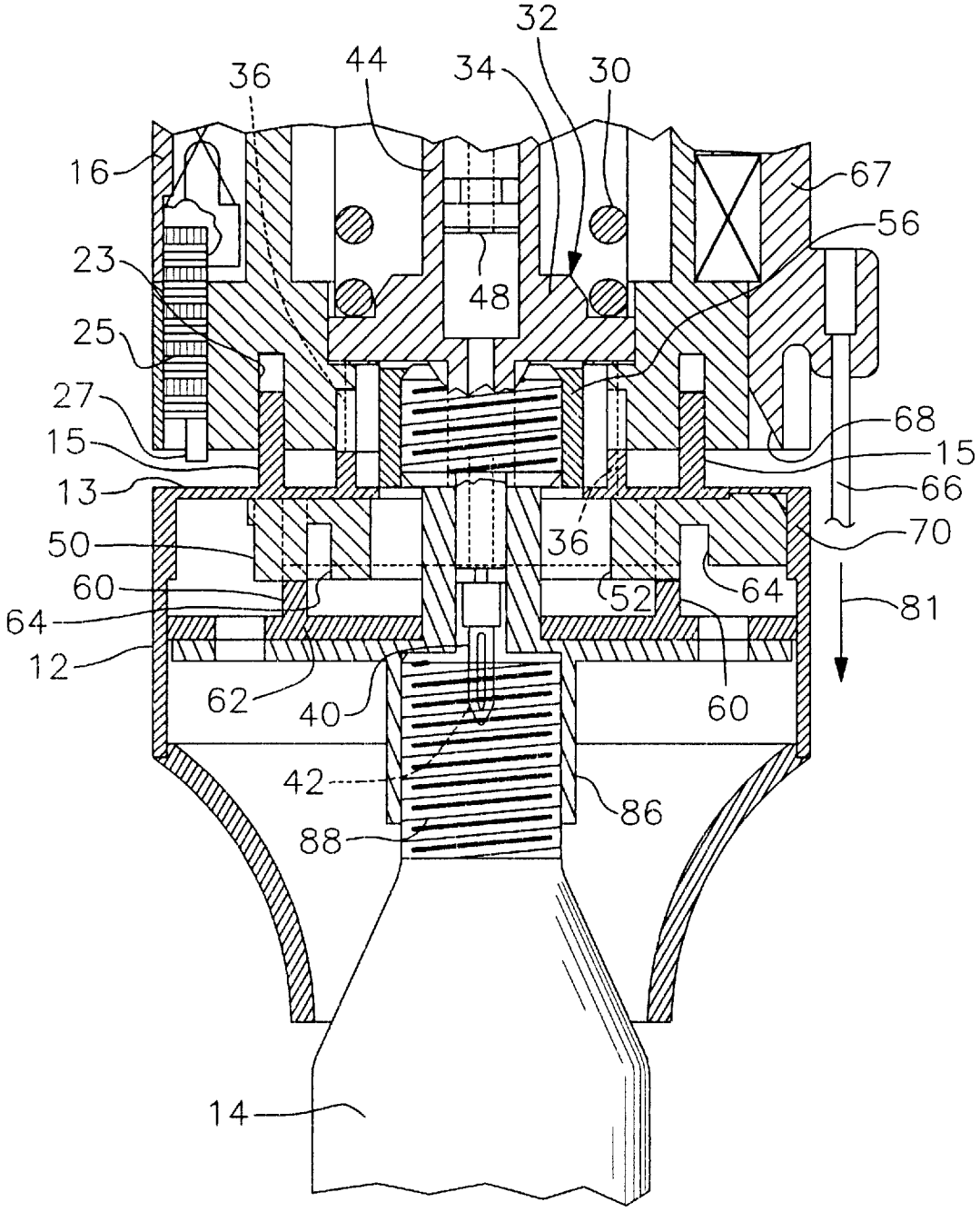
FIG. 9 is an enlarged sectional view of the inflator and cartridge status indicator after collapse of the dissolvable element.

The improvement in $CO_2$ cartridges includes a cartridge status indicator 12 that is permanently mounted to a $CO_2$ cartridge 14, i.e., the purchaser of cartridge 14 receives cartridge status indicator 12 therewith. Importantly, the cartridge and cartridge status indicator are mounted to one another by a novel mounting means that positions the cartridge status indicator in a first and in a second position relative to said cartridge, said positions being in axial alignment with one another. The first position is depicted in FIG. 1 and the second position is depicted in FIGS. 8 and 9. The second position is achievable only if the membrane of cartridge 14 has been pierced, i.e., if the cartridge has been used.

The novel cartridge/cartridge status indicator unit is detachably engaged to a novel inflator means 16 by releasable attachment means disclosed hereinafter.

A first supplemental indicia means 18 is formed on cartridge status indicator 12, said indicia means indicating that cartridge 14 is unused when said cartridge status indicator 12 is in said first position relative to said cartridge 14 and said indicia means indicating that said cartridge is used when said cartridge status indicator 12 is in said second position relative to said cartridge.

Figure 2:
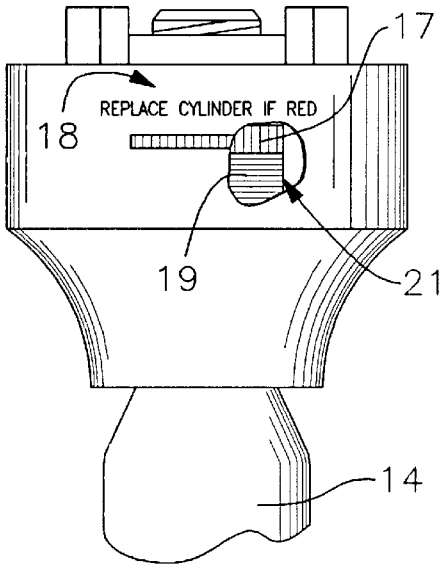
FIG. 2 is a front elevational, partially broken away view of the novel cartridge status indicator.
Figure 6:
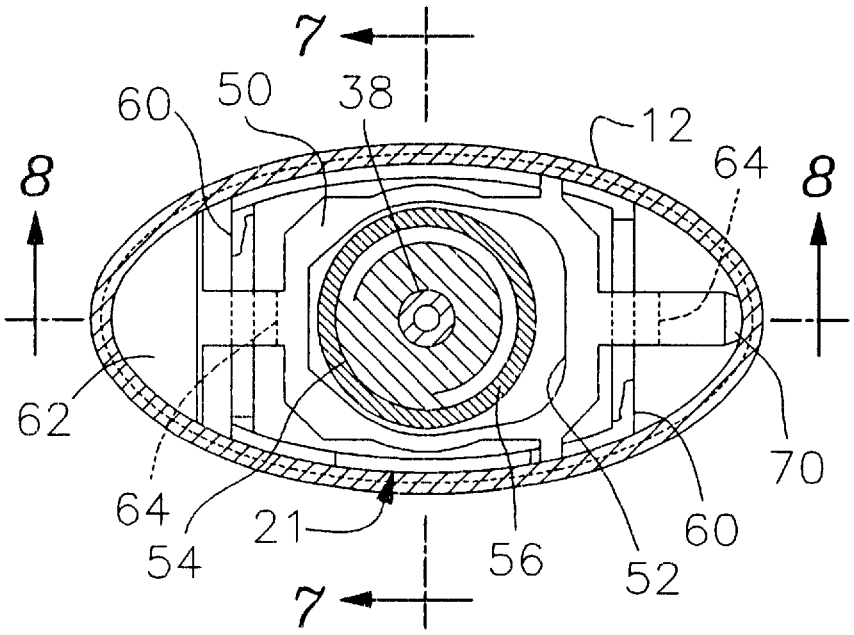
FIG. 6 is a sectional view taken along line 6—6 in FIG. 4.
Figure 7:
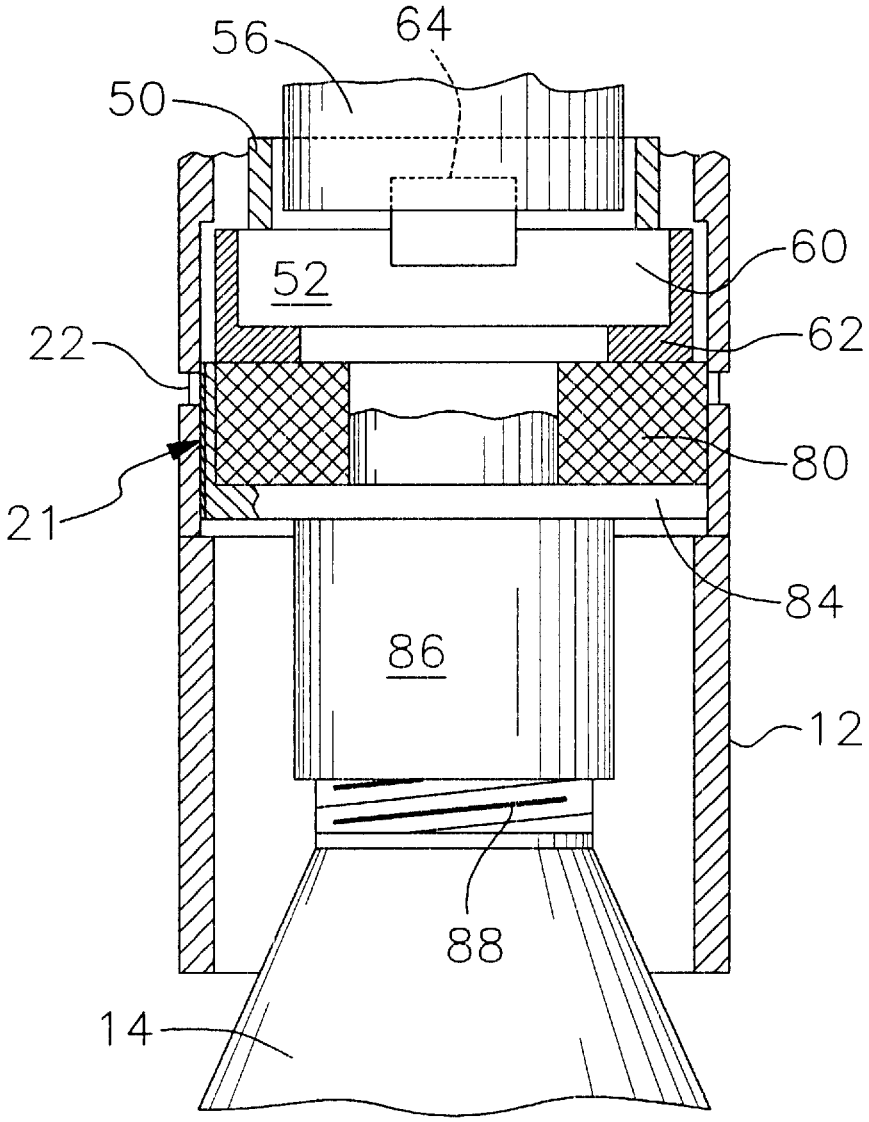
FIG. 7 is an enlarged sectional view taken along line 7—7 in FIG. 6.

More particularly, cartridge status indicator 12 has a window 22 formed therein, and a mounting plate 84 (FIG. 7) is housed within said cartridge status indicator. A status indicating means, denoted 21 in FIGS. 2, 6, and 7, is affixed to said mounting plate 84. Means 21 is color-coded; a green part thereof is denoted 17 and a red part thereof is denoted 19. The former indicates that the cartridge has not yet been used and the latter indicates that the cartridge must be replaced. Window 22 aligns with green section 17 when cartridge status indicator 12 is in said first position and said window aligns with red section 19 when cartridge status indicator 12 is in said second position. Alternatively, mounting plate 84 could be color coded (with means 21 being transparent), or a strip of color coded material could be attached to mounting plate 84 in operative registration with window 22.

Figure 3:
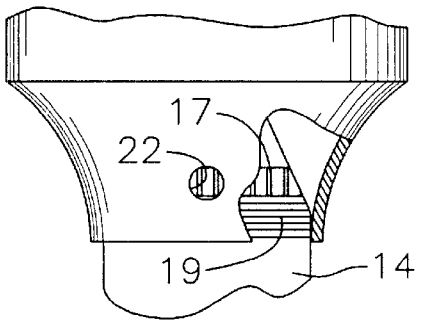
FIG. 3 is a front elevational, broken away view of a second embodiment of the novel cartridge status indicator.

An alternative embodiment is depicted in FIG. 3. Green and red indicator strips, 17 and 19, respectively, are attached to cartridge 14 and a suitable window 22 formed in cartridge status indicator 12 aligns with the green indicator when cord 66 has not been pulled and element 80 has not been dissolved, i.e., when cartridge 14 and cartridge status indicator 12 are in their first position. The red indicator is exposed to view when said parts assume their second position, i.e., when cord 66 has been pulled or element 80 has collapsed.

Figure 4:
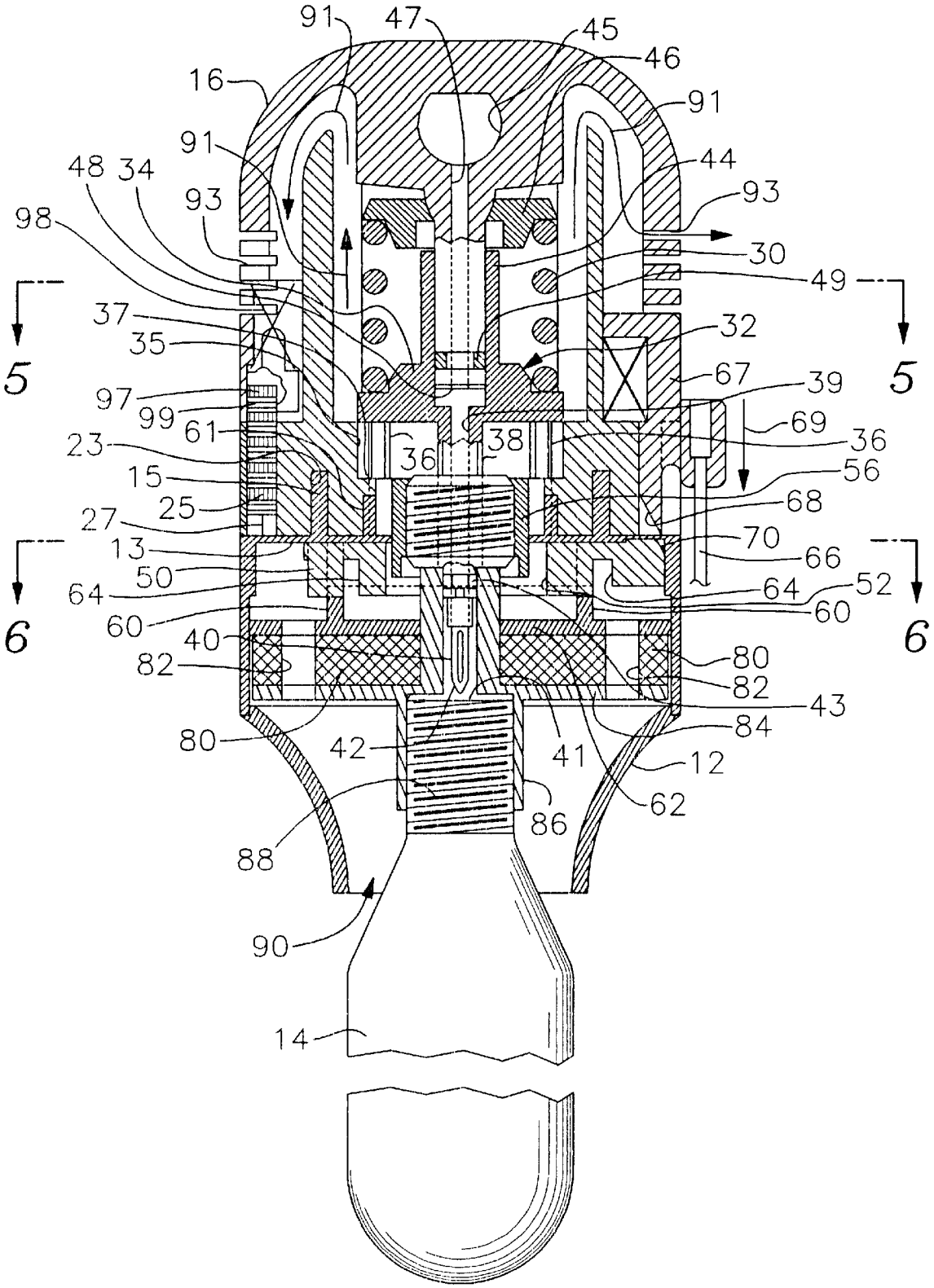
FIG. 4 is an enlarged sectional view of the novel inflator and cartridge status indicator before activation thereof.

As depicted in FIG. 4, a bias means 30, preferably in the form of a coil spring as depicted, is mounted within inflator 16, and a pierce pin guide assembly 32 has a flange disposed in abutting relation to a leading end of said bias means. Pierce pin guide assembly 32 includes a base 34, a plurality of longitudinally extending peripheral legs, collectively denoted 36, having a common length and a longitudinally extending central leg 38 having a length greater than said common length. The peripheral legs 36 and central leg 38 project in a first direction relative to pierce pin assembly base 34 in parallelism with one another and in parallel relation to a longitudinal axis of inflator 16. The peripheral mounting of legs 36 is perhaps best understood in connection with FIG. 5.

As indicated in FIG. 4, pierce pin 40 has a base secured to central leg 38 and a pointed free end 42 for piercing a cartridge membrane 41. Sealing ring 43 constrains escaping gas to flow in bore 39 of said leg 38.

Pierce pin assembly 32 further includes a central sleeve 44 that projects in a second direction relative to pierce pin assembly base 34, said second direction being opposite to said first direction.

A spider assembly 46 is disposed in abutting relation to a trailing end of bias means 30. Said assembly 46 is mounted to a central post 48, formed integrally with inflator 16, that is slideably received within pierce pin assembly central sleeve 44. Bias means 30 urges pierce pin assembly 32 and hence pierce pin 40 in said first direction. Escaping gas is constrained to flow to manifold opening 45 through bore 47 by sealing ring 49 which is seated in an annular groove formed near the leading end of central post 48.

A guide plate 13, having integrally formed upstanding guide plate legs 15 formed therein, abuttingly engages the respective leading ends of peripheral legs 36 when bias means 30 is in repose. Upstanding guide plate legs 15 are slideably received within blind bores 23 formed in inflator 16. Note that guide plate 13 is an integral part of cartridge status indicator 12.

As also depicted in FIG. 4, support member 50, disposed in cartridge status indicator 12, abuttingly engages guide plate 13 when bias means 30 is in repose. Central bore 52 formed in support member 50 accommodates externally threaded base 54 of pin 40 and internally threaded sleeve 56 which is slideably mounted within said bore 52. As indicated in FIG. 6, support member 50 is a frame-like member having central opening 52 for accommodating sleeve 56.

Support member 50 is supported by upstanding support plate legs 60 which are formed integrally with support plate 62. By comparing FIGS. 4 and 8, it will be observed that leg-receiving blind bores 64, formed in support member 50, fully receive upstanding support plate legs 60 when support member 50 is shifted laterally from its FIG. 4 position to its FIG. 8 position. The lateral shift (to the left as drawn) is caused by a manual pull exerted upon cord 66; said pull displaces beveled surface 68, formed in slideably mounted handle 67, in the direction indicated by directional arrow 69 (FIG. 4) so that it abuttingly engages and shifts mating beveled surface 70 formed in a peripheral edge of support member 50. Cord 66 has not been pulled in FIG. 4, but it has been pulled in FIG. 8. When support member 50 is shifted laterally as depicted in FIG. 8, peripheral legs 36, under the influence of bias means 30, drive guide plate 13 and hence support member 50 in the direction indicated by arrow 69. Base 34 of pierce pin assembly 32 and hence pierce pin 40 are driven in the same direction. Base 34 enters into bore 35 formed in inflator 16 until it abuts shoulder 37 (FIG. 4), and pin 40 penetrates membrane 41 as depicted in FIG. 8 to release the liquified gas therefrom.

In other words, upstanding support plate legs 60 and support member blind bores 64 are misaligned when cord 66 has not been pulled, as indicated in FIG. 4, but pulling said cord shifts support member 50 in a lateral direction and brings said legs and bores into alignment, thereby allowing bias means 30 to unload and drive said blind bores into ensleeving relation with upstanding support plate legs 60.

Due to the upright configuration of cartridge 14, the liquified gas is not resting against membrane 41 at the moment of puncture, but is spaced downwardly therefrom. Accordingly, the gas evaporates out of the puncture opening, i.e., it is not in a liquid state as it flows through said puncture opening. The gaseous fluid flows first through elongate bore 39 (FIG. 4) and then through bore 47 which is in fluid communication with opening 45 to which is connected a manifold, not shown, of an inflatable article, not shown.

Note in FIG. 4 that dissolvable element 80 supports support plate 62 and that the inventive parts will behave as described above as long as said dissolvable element is not subjected to moisture. Thus, pulling on cord 66 causes rapid inflation of whatever inflatable article is in fluid communication with manifold opening 45, even if dissolvable element 80 has encountered no moisture.

Plural bores, collectively denoted 82, are formed in dissolvable element 80 to enhance the admission of moisture thereinto. Mating bores for the same purpose are formed in support plate 62 and mounting plate 84, said plates being disposed in sandwiching relation to dissolvable element 80. Internally threaded boss 86 is integral with mounting plate 84 and depends therefrom; external threads 88 of cartridge 14 permanently engage said internal threads, i.e., cartridge 14 is not removable from boss 86. Thus, cartridge 14 is permanently affixed to cartridge status indicator 12.

As will be understood upon comparison of FIGS. 4 and 9, when dissolvable element 80 collapses upon contact with moisture, as indicated in said latter Fig., bias means 30 unloads and peripheral legs 36 drive guide plate 13 and hence support member 50 and pierce pin 40 in the direction indicated by directional arrow 81, thereby puncturing membrane 41. This action occurs even when upstanding support plate legs 60 and support member blind bores 64 are misaligned as depicted.

Moisture entering inflator 16 normally enters as at 90 and encounters dissolvable element 80. The directional arrows collectively denoted 91 in FIG. 4 denote a path of travel that air follows when driven out of the inflator by incoming water. If splashed water enters inflator 16 through air vent 93, said water must follow a torturous path of travel (in the reverse direction of arrows 91) before it can encounter dissolvable element 80; this reduces the chances of an unwanted puncturing of membrane 41.

Dissolvable element 80, as depicted, has a predetermined thickness greater than a predetermined depth of blind bores 64 formed in support member 50. Accordingly, dissolution of element 80 has substantially the same effect on bias means 30 as alignment of upstanding support plate legs 60 and support member blind bores 64, said same effect being the unloading of said bias means and the driving of said pierce pin into said membrane; the penetration of point 42 of pin 40 is greater in FIG. 9 than in FIG. 8 due to said aforesaid dimensional differences, but said dimensions could be equalized if desired to achieve the same amount of penetration regardless of which event results in puncturing of the membrane. Any puncture will suffice, i.e., the depth of penetration is not important.

Plural status indicator windows 95 (FIG. 1) are formed in inflator 16. As depicted in FIG. 4, strips of green and red color, denoted 97, 99, respectively, are mounted on a slideably mounted indicator member 25 having a depending protrusion 27. When guide plate 13 is in its FIG. 4 position, i.e., when cord 66 has not been pulled and element 80 has not been contacted by moisture, said guide plate abuts protrusion 27 and indicator member 25 is in a retracted configuration; thus, green strips 17 appear through windows 95. When cord 66 has been pulled, or element 80 dissolved, guide plate 13, under the influence of bias means 30, separates from said protrusion, as indicated in FIG. 9, allowing sliding displacement of indicator member 25, under the influence of spring 98 and a red strip 19 appears through windows 95.

Figure 5:
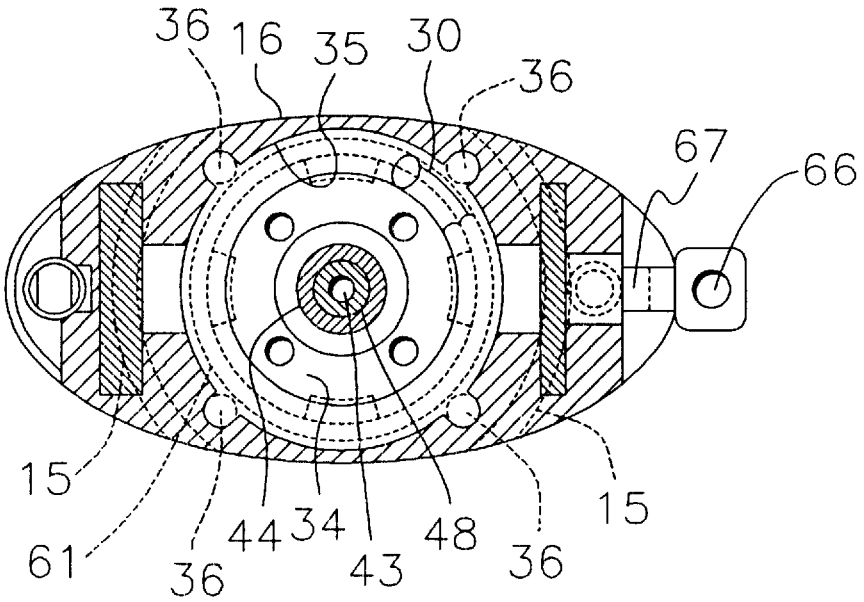
FIG. 5 is a sectional view taken along line 5—5 in FIG. 4.

It is worth noting how cartridge status indicator 12 and inflator 16 mate with one another when a proper connection therebetween has been made. As is readily apparent from FIG. 1, if a small cartridge status indicator 12 is attached to a large inflator 16, or vice versa, the mismatch will be readily apparent. No such visual indication of a mismatch is provided in prior art devices. Moreover, as indicated in FIGS. 5 and 6, the profile of cartridge status indicator 12 and inflator 16 is substantially elliptical or oval; thus, a skewing between the two parts will be apparent if cartridge status indicator 12 is not properly screwed into inflator 16 (by the engagement of externally threaded base 54 and the internal threads formed in sleeve 56). Thus, the shape of the parts provides an intuitive indication as to how they should be connected to one another.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An improvement in gas inflators, comprising:

a cartridge status indicator;

said cartridge status indicator being nonremovably mounted to a gas cartridge;

said cartridge status indicator having a first position with respect to said cartridge indicating nonuse of said cartridge;

said cartridge status indicator having a second position with respect to said cartridge indicating use of said cartridge;

said cartridge status indicator and said cartridge being in axial alignment with one another when said cartridge status indicator is in said first and second positions;

said second position of said cartridge status indicator being axially spaced apart from said first position of said cartridge status indicator by a distance sufficient to be readily visually ascertainable, said cartridge status indicator having an entrance passageway configured to receive gas from said gas cartridge, and an exit passageway configured to permit the gas to flow from the entrance passageway and out through said cartridge status indicator;

said first and second, axially spaced apart positions of said cartridge status indicator relative to said cartridge providing a first indication of the used/not used status of said cartridge, wherein the used status of the cartridge is defined by the gas being free to flow from the cartridge, and the not used status of the cartridge is defined by the gas being retained within the cartridge.

2. The improvement of claim 1, further comprising:

a window means formed in said cartridge status indicator;

a slideably mounted indicator member disposed within said cartridge status indicator;

a first indicia means mounted on said indicator member;

a second indicia means mounted on said indicator member;

said first and second indicia means disposed in axially spaced relation to one another;

said first indicia means being visible through said window means when said cartridge status indicator is in said first position; and said second indicia means being visible through said window means when said cartridge status indicator is in said second position;

whereby said first and second indicia means provide a second indication as to the status of said gas cartridge because said first indicia means is visible through said window means only when said cartridge status indicator is in said first position and said second indicia means is visible through said window means only when said cartridge status indicator is in said second position.

3. The improvement of claim 2, further comprising:

an inflator; and releasable attachment means for detachably engaging said cartridge status indicator to said inflator.

4. The improvement of claim 3, further comprising:

a bias means mounted within said inflator;

a pierce pin and a pierce pin assembly disposed in abutting relation to a leading end of said bias means;

said pierce pin assembly being slideably mounted so that unloading of said bias means drives said pierce pin through a cartridge membrane; and means holding said pierce pin in retracted relation relative to said cartridge membrane.

5. The improvement of claim 4, wherein said pierce pin assembly further comprises:

a base member disposed at said leading end of said bias means;

a plurality of peripheral legs having a common length formed integral with said base member;

a central leg, integral with said base member, having a length greater than said common length;

said peripheral legs and said central leg projecting in a first direction relative to said base member in parallelism with one another and in parallel relation to a longitudinal axis of said inflator;

said pierce pin having a base engaged by said central leg and a pointed free end for piercing said cartridge membrane;

said pierce pin assembly further including a central sleeve that projects in a second direction relative to said pierce pin assembly base member, said second direction being opposite to said first direction;

a spider assembly disposed in abutting relation to a trailing end of said bias means;

said spider assembly including a central post that is slideably received within said pierce pin assembly central sleeve;

whereby said bias means urges said pierce pin assembly and hence said pierce pin in said first direction.

6. The improvement of claim 5, wherein said releasable attachment means comprises;

a guide plate member, integral with said cartridge status indicator, disposed in abutting relation to said inflator;

a plurality of upstanding guide legs formed in said guide plate member;

a corresponding plurality of blind bores formed in said inflator;

each guide leg of said plurality of guide legs being respectively slideably received within an associated blind bore of said plurality of blind bores when said cartridge status indicator is in a first position relative to said inflator and when in a second position relative to said inflator so that said cartridge status indicator does not separate from said inflator when said cartridge membrane is pierced;

said slideable connection of said guide legs and said blind bores maintaining axial alignment between said inflator and said cartridge status indicator when said cartridge status indicator is displaced into its second position.

7. The improvement of claim 6, further comprising:

said peripheral legs abutting said guide plate member;

a support member disposed in said cartridge status indicator, said support member being mounted for lateral displacement within said cartridge status indicator;

a support plate disposed within said cartridge status indicator in abutting relation to said support member;

a plurality of upstanding legs formed in said support plate, said plurality of upstanding support plate legs abutting said support member;

a plurality of blind bores formed in said support member, said plurality of blind bores of said support member being misaligned with said plurality of upstanding support plate legs when said support member is in a position of repose;

said guide plate member maintaining said peripheral legs and hence said pierce pin in spaced relation to said membrane when said support member is in said position of repose; and said upstanding support plate legs entering into said plurality of blind bores of said support member when said support member is laterally displaced from its position of repose, said bias means driving said peripheral legs and hence said guide plate member, support member, and piercing pin toward said cartridge membrane so that said cartridge membrane is punctured by said piercing pin.

8. The improvement of claim 7, further comprising:

a beveled surface formed in a peripheral edge of said support member, a handle member slideably mounted on said inflator, a handle member beveled surface integrally formed with said handle member, said handle member beveled surface adapted to slidingly engage and laterally displace said support member beveled surface when said handle member is displaced from a first position to a second position relative to said inflator, said lateral displacement bringing into alignment said upstanding support plate legs with said support member blind bores.

9. The improvement of claim 8, further comprising:

a dissolvable element disposed in said cartridge status indicator in abutting relation to said support plate; and passageway means formed in said inflator, said passageway means being in fluid communication with said dissolvable element;

said dissolvable element having a predetermined thickness so that dissolution of said dissolvable element has substantially the same effect on said bias means as alignment of said upstanding support plate legs and said support member blind bores, said same effect being said unloading of said bias means and driving of said pierce pin into said cartridge membrane.

10. The improvement of claim 9, further comprising:

a plurality of inflator windows formed in said inflator;

a second indicator member slideably mounted in said inflator in registration with said plurality of inflator windows;

a first status indicating means of a first color being on said second indicator member and being visible through each inflator window of said plurality of inflator windows when said cartridge status indicator is in said first position;

a second status indicating means of a second color being on said second indicator member and being visible through each inflator window of said plurality of inflator windows when said cartridge status indicator is in said second position;

a bias means disposed within said inflator that urges against a trailing end of said second indicator member and thereby urges a leading end of said second indicator member into abutting relation to said guide plate member;

said second indicator member being in a retracted position and said first status indicating means being visible through said plurality of inflator windows when said cartridge status indicator is in said first position; and said second indicator member being in an extended position and said second status indicating means being visible through said plurality of inflator windows when said cartridge status indicator is in said second position;

said second indicator member providing a third indication of the status of said cartridge.

11. The improvement of claim 1, further comprising:

a window means formed in said cartridge status indicator;

an indicia means including a first and a second indicia means attached to said cartridge in axially spaced relation to one another;

said indicia means indicating that said cartridge is unused when said cartridge status indicator is in said first position and said first indicia means is visible through said window means and said indicia means indicating that said cartridge is used when said cartridge status indicator is in said second position and said second indicia means is visible through said window means.

* * * * *